US006751962B1

(12) United States Patent
Kuwabara et al.

(10) Patent No.: US 6,751,962 B1
(45) Date of Patent: Jun. 22, 2004

(54) TAIL TUBE SEAL STRUCTURE OF COMBUSTOR AND A GAS TURBINE USING THE SAME STRUCTURE

(75) Inventors: Masamitsu Kuwabara, Hyogo (JP); Yasuoki Tomita, Hyogo (JP); Kiyoshi Suenaga, Hyogo (JP); Masahito Kataoka, Hyogo (JP); Yoshichika Sato, Hyogo (JP); Koji Watanabe, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/521,413

(22) Filed: Mar. 8, 2000

(30) Foreign Application Priority Data

Mar. 8, 1999 (JP) ..... 11-060321

(51) Int. Cl.[7] ..... F23R 3/60
(52) U.S. Cl. ..... 60/800; 60/752
(58) Field of Search ..... 60/39.31, 39.32, 60/752, 759, 760, 800

(56) References Cited

U.S. PATENT DOCUMENTS 2,699,040 A * 1/1955 Gaubatz ..... 60/752
3,965,066 A * 6/1976 Sterman et al. ..... 60/39.32
4,901,522 A 2/1990 Commaret et al.
5,079,915 A 1/1992 Veau
5,265,412 A 11/1993 Bagepalli et al.
5,398,496 A * 3/1995 Taylor et al. ..... 60/752
5,400,586 A 3/1995 Bagepalli et al.
5,480,162 A 1/1996 Beeman, Jr.
6,148,604 A * 11/2000 Salt et al. ..... 60/39.32

FOREIGN PATENT DOCUMENTS

EP 0 615 055 A1 9/1994
JP 62-176448 11/1987

* cited by examiner

*Primary Examiner*—Michael Koczo
(74) *Attorney, Agent, or Firm*—Sughrue Mion, PLLC

(57) ABSTRACT

In a tail tube seal structure of gas turbine, a U-shaped groove is provided at one side of a tail tube seal where a flange of a tail tube outlet is fitted, and a pi-shaped groove is provided at other side of the tail tube seal where a gas pass side flange end is fitted, thereby composing the seal of the connection area. Inclined cooling holes are drilled in the tail tube seal in addition to the cooling holes existing conventionally. The cooling air flows in from the inclined holes and cools the gas pass side of the groove due to the film effect. Therefore, the difference in thermal expansion between the groove and flange end is decreased, the wear of this area is decreased, and the reliability of the seal is enhanced.

12 Claims, 10 Drawing Sheets

TAIL TUBE SEAL STRUCTURE OF COMBUSTOR AND A GAS TURBINE USING THE SAME STRUCTURE

FIELD OF THE INVENTION

The present invention relates to a tail tube structure of gas turbine combustor. More particularly, this invention relates to a structure for enhancing the performance of gas turbine by increasing the cooling effect in the tail tube seal, decreasing the cooling air flow to save the air consumption, and decreasing the load of the compressor.

BACKGROUND OF THE INVENTION

FIG. 9 is a general structural diagram of a combustor of a gas turbine. Reference numeral 80 indicates a combustor. This combustor 80 is fixed in a casing 81. Reference numeral 82 indicates a pilot fuel nozzle. Pilot fuel to be used for ignition is supplied to the pilot fuel nozzle 82. Reference numeral 83 indicates a main fuel nozzle. A plurality of main fuel nozzles (for example eight in number) are arranged in a circle around the pilot fuel nozzle 82. Reference numeral 84 indicates an inner tube, and 85 indicates a tail tube. The inner tube 84 and the tail tube 85 guide a high temperature combustion gas 200 towards an outlet 86 of the tail tube 85 (hereafter tail tube outlet). Reference numeral 87 indicates a bypass pipe, and 88 indicates a bypass valve. The bypass valve 88 gets opened when the combustion air becomes insufficient because of the fluctuations in the load. When the bypass valve 88 gets opened, a passage is created for guiding the air in the casing 81 into the combustor 80. Reference numeral 89 indicates a seal section. This seal section 89 is provided at the peripheral end of the tail tube outlet 86 as described below. The seal section 89 is intended to seal the connection area with gas passage (alternatively the "gas pass") 100 of the gas turbine. A plurality of such combustors 80 (for example sixteen in number) are disposed around the rotor in the casing 81. Each combustor 80 supplies the high temperature combustion gas into the gas pass 100. This combustion gas expands in the gas pass 100 to work and rotate the rotor.

In the combustor having such constitution, the fuel from the main fuel nozzle 83 is mixed with the air sucked from around. The mixture of fuel and air is ignited by the flame of the pilot fuel from the pilot fuel nozzle 82. The mixture burns to form a high temperature combustion gas 200. The high temperature combustion gas 200 is supplied from the tail tube outlet 86 into the gas pass 100 through the inner tube 84 and tail tube 85. Since the wall of the inner tube 84 and the wall of the tail tube 85 always come in contact with the high temperature combustion gas 200, a cooling passage for passing cooling air is provided in these walls in order to cool them. Moreover, the tail tube outlet 86 is connected to the periphery of the inlet of the gas pass 100 through the seal section 89. This seal section 89 is also cooled using the cooling air.

FIG. 10 is a magnified sectional view of portion Y in FIG. 9. This figure shows a detail structure of a conventional tail tube seal. Reference numeral 89 indicates the entire seal section. A flange 86*a* is formed around the tail tube outlet 86. The wall of the tail tube is exposed to high temperature combustion gas 200, for example, the temperature of the gas as high as 1500 degree centigrade. However, multiple passages (not shown) for cooling air are formed in the wall of the tail tube 85, and the wall is cooled by the cooling air. Further, a groove 90 for cooling air is also formed around the tail tube outlet 86. The tail tube outlet 86 is cooled by passing the cooling air in this groove 90.

The tail tube outlet 86 is connected to the gas pass 100 through a tail tube seal 61. One end of the tail tube seal 61 has a U-shaped groove 61*a*. A peripheral flange 86*a* of the tail tube outlet 86 is fitted into this groove 61*a*. The other end of the tail tube seal 61 has a pi-shaped groove 61*b*. Flange ends 102*a*, 103*a* of an outer shroud 102 and an inner shroud 103 of a first stage stationary blade 101 in the gas pass 100 are fitted into this groove 61*b*, thereby sealing the connection area.

Since the tail tube seal 61 is also exposed to high temperature combustion gas 200 as mentioned above, multiple cooling holes 61*c* are drilled around the tail tube seal 61 in a direction which is perpendicular to the direction into which the gas flows at the inlet of the gas pass 100. High pressure air 91 flows in from around the combustor in the casing and cools the wall of the tail tube seal 61. After cooling, this air flows into the gas pass 100. The amount of cooling air required to cool the tail tube seal 61 is about 1 to 2% of the amount of compressed air discharged from the compressor.

Thus, in the tail tube seal of the conventional gas turbine combustor, air holes 61*c* are drilled on the periphery of the tail tube seal 61 and the tail tube seal 61 is cooled by passing cooling air 91 in the air holes 61*c*. The periphery of the holes 61*c* is cooled by passing cooling air into the holes 61*c*, however, the side of the groove 61*b* connecting to the gas pass 100 side is not cooled sufficiently by passing cooling air into the holes 61*c* alone. As the cooling is insufficient, the flange ends 102*a*, 103*a* towards the gas pass side expand due to thermal expansion. This thermal expansion of the flange ends 102*a*, 103*a* generates a frictional force at the contact with the groove 61*b* and the groove 61*b* is worn. Thus, the performance of the tail tube seal 61 is impaired.

Moreover, the amount of air required to cool the tail tube seal 61 is about 1 to 2% of the entire amount of compressed air discharged from the compressor. However, it is desirable that this air consumption is as little as possible, because, when the air consumption is less, the efficiency of the compressor can be improved and the performance of the gas turbine can be enhanced. Such a decrease in the air consumption was in demand but was not realized till present.

SUMMARY OF THE INVENTION

It is an object of the present invention to present a tail tube seal structure of a combustor capable of improving the cooling structure of the tail tube seal of a combustor of gas turbine, raising the cooling effect, curtailing the amount of air by cooling by a smaller amount of air, and contributing to an upgraded performance of the entire gas turbine.

According to one aspect of the present invention, the air in the casing flows in from a plurality of inclined cooling holes and flows out obliquely into the gas pass, and cools the wall contacting with the gas passage in the groove in which the flange end of the gas pass is fitted by film effect, the cooling in this area is reinforced. Owing to this cooling, the conventional problem of wear due to difference in thermal expansion between the fitting section of the member and the gas pass side flange end to be fitted is decreased, and the reliability of the tail tube seal structure is enhanced.

Further, the gas pass is generally in a cylindrical shape, and the inclined cooling holes are formed at specific intervals in the entire peripheral direction. Therefore, the inner wall of the gas pass can be cooled uniformly and efficiently also in the peripheral direction.

Further, the air flowing out from the inclined cooling holes flows smoothly along the inner wall of the gas pass side formed of a smooth curvature. Therefore, the film cooling effect is enhanced, and the cooling of the flange end at the gas pass side is further effective.

According to one aspect of the present invention, the seal member is fitted outside to the flange of the outer circumference of the tail tube outlet, and also fitted to the protrusion at the gas pass side on the outer periphery of the tail tube outlet wall. Therefore, the member itself does not come in contact with the high temperature combustion gas. Hence, it is not necessary to cool the member itself, and hence cooling holes and cooling are not needed. Instead, to reinforce cooling of the tail tube outlet wall, inclined cooling holes are provided around the tail tube outlet wall, and air is passed in the cooling holes to flow out in the gas passage to cool, and this cooling is a further addition to the conventional cooling of the tail tube wall inside. Therefore, in the present invention, the effect of the high temperature combustion gas in the tail tube seal is much smaller than in the prior art, and the consumption of cooling air is saved substantially.

Further, the seal member is placed in the fitting section between the tail tube outlet flange and the protrusion member at the gas pass side, the tail tube outlet peripheral flange end and the gas pass side protrusion are sealed securely, and the effect of the present invention is further encouraged.

Further, a brush seal is used. This brush seal seals by contacting with the smooth plane of the flange end of the gas pass side, and if a relative deviation occurs between the gas pass side flange end and the tail tube side, by sliding of the brush seal. Therefore, it is possible for the brush seal to move relatively depending on the deviation, and excessive force is not applied to the connection area, so that the reliability of the tail tube seal is enhanced.

Further, since a brush seal is used, in addition to the above effects, if a relative deviation occurs between the gas pass inlet side and the tail tube side, it is possible to move relatively, corresponding to this deviation, by sliding of the brush seal without spoiling the sealing performance, and excessive force is not applied to the connection area, so that the effects of the present invention may be assured.

Further, the shape of the inclined cooling holes is either circular or elliptical, and the hole shape can be selected depending on the type or structure of combustor, or by forming slender holes, the number of holes may be decreased, and the shape of the inclined cooling holes may be selected appropriately depending on the size or shape of the combustor, size at the gas pass side and other conditions, and the freedom of design is wider, which contributes to optimum designing.

According to still another aspect of the present invention, from the variety of tail tube seal structures exemplified herein, the best tail tube seal structure can be selected depending on the capacity or type of the gas turbine, and by using it, a gas turbine enhanced in the cooling effect in the tail tube seal, curtailed in the amount of cooling air, and enhanced in performance is realized.

Other objects and features of this invention will become apparent from the following description with reference to the accompanying drawings.

BRIEF DESCRIPTION OF THE DRAWINGS

FIG. 7A to FIG. 7F are representative of alternative cross sectional views when seen along the arrows 7—7 shown in FIG. 6, in which FIG. 7A to FIG. 7C show alternative examples, and FIG. 7D to FIG. 7F show side views, respectively, of FIGS. 7A–7C;

DESCRIPTION OF THE PREFERRED EMBODIMENTS

Figure 1:
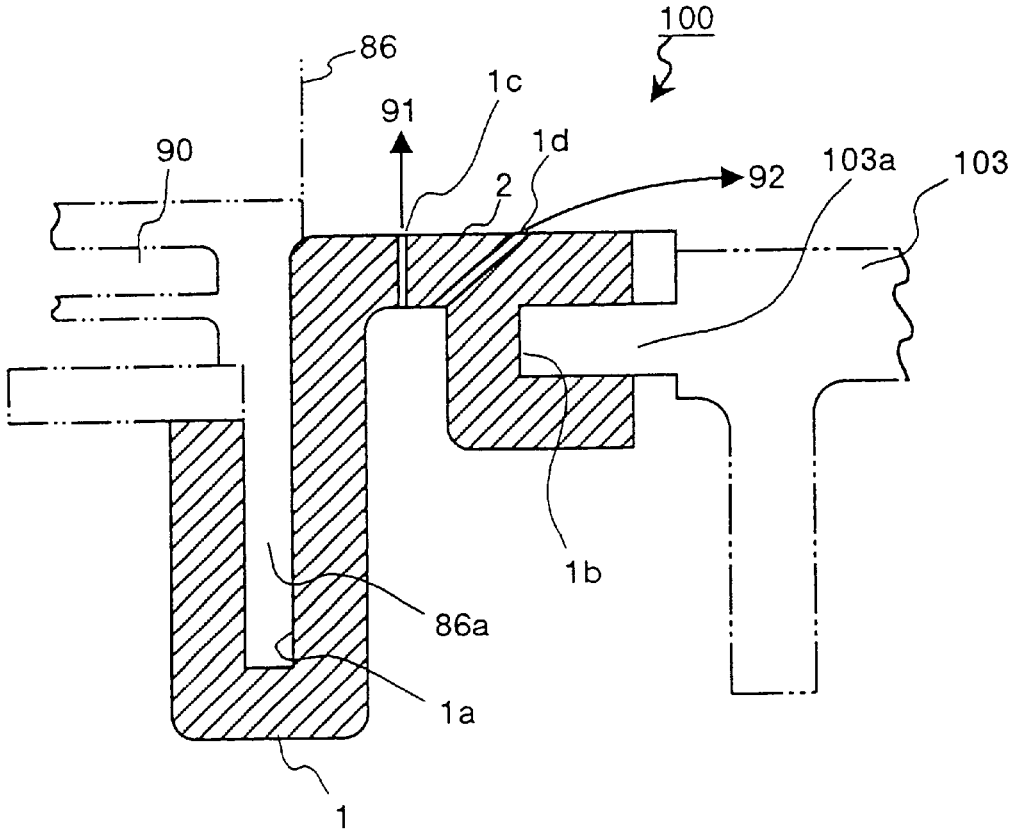
FIG. 1 is a partial sectional view of a tail tube seal structure of gas turbine combustor according to a first embodiment of the present invention.

Referring now to the drawings, preferred embodiments of the present invention are described in detail below. FIG. 1 is a cross sectional view of a tail tube seal structure of a gas turbine combustor according to a first embodiment of the present invention. The figure shows only the inside part. The tail tube outlet 86 side is provided with a cooling groove 90 in the circumference in the same manner as in the conventional art and it is cooled by the cooling air. The peripheral flange 86*a* of the tail tube outlet 86 and the flange 103*a* of the gas pass side are connected through grooves 1*a*, 1*b* of the tail tube seal 1.

Figure 10:
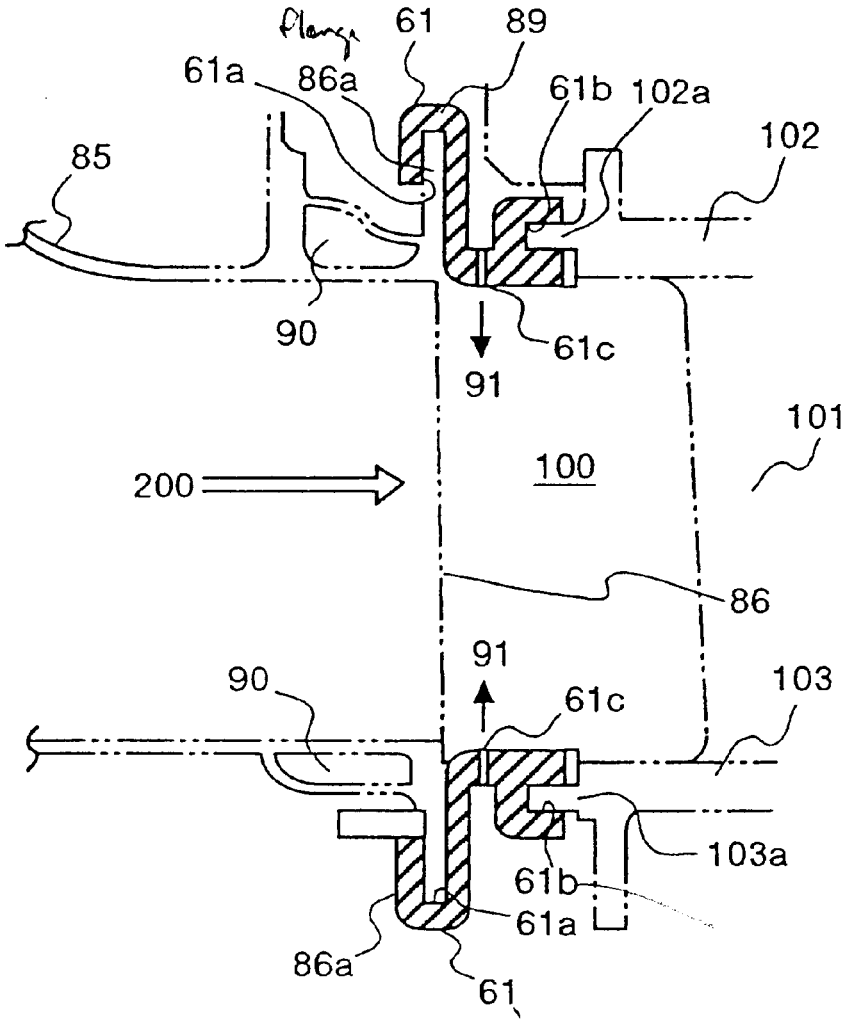
FIG.10 CONVENTIONAL ART
FIG. 10 is a cross sectional view of a tail tube seal structure of gas turbine combustor in the conventional art.

The shape of the tail tube seal 1 is basically the same as that of the conventional tail tube seal 61 shown in FIG. 10, except that a cooling hole 1*d* is provided therein. The cooling hole 1*c* is drilled at the same position the cooling hole 61*c* shown in FIG. 10. Air 91 is allowed to flow out into the inner wall of the connection area of the tail tube seal 1 thereby cooling the periphery. Moreover, in this embodiment, the inclined cooling hole 1*d* is drilled obliquely in the wall 2 of the gas passage side of the groove 1*b* and it opens to the gas passage side.

Cooling air 92 flows into this cooling hole 1*d* from outside, and the air 92 is blown out obliquely from the wall of the high temperature gas passage side of the pi-shaped groove 1*b*, and this portion is cooled, and the part of the groove 1*b* to which the gas pass side flange end 103*a* is fitted is cooled, thereby lessening the effect of difference in thermal expansion between the tail tube seal member of gas pass side and the flange end 103*a* on the junction, and the wear of the tail tube seal 1 and flange end 103*a* is decreased, and hence the reliability is enhanced.

Moreover, when the inclined cooling holes 1*d* are provided at specific intervals on the entire peripheral direction of the wall 2 along the gas pass of the tail tube seal 1, the inner wall of the gas pass can be cooled uniformly and efficiently.

Figure 2:
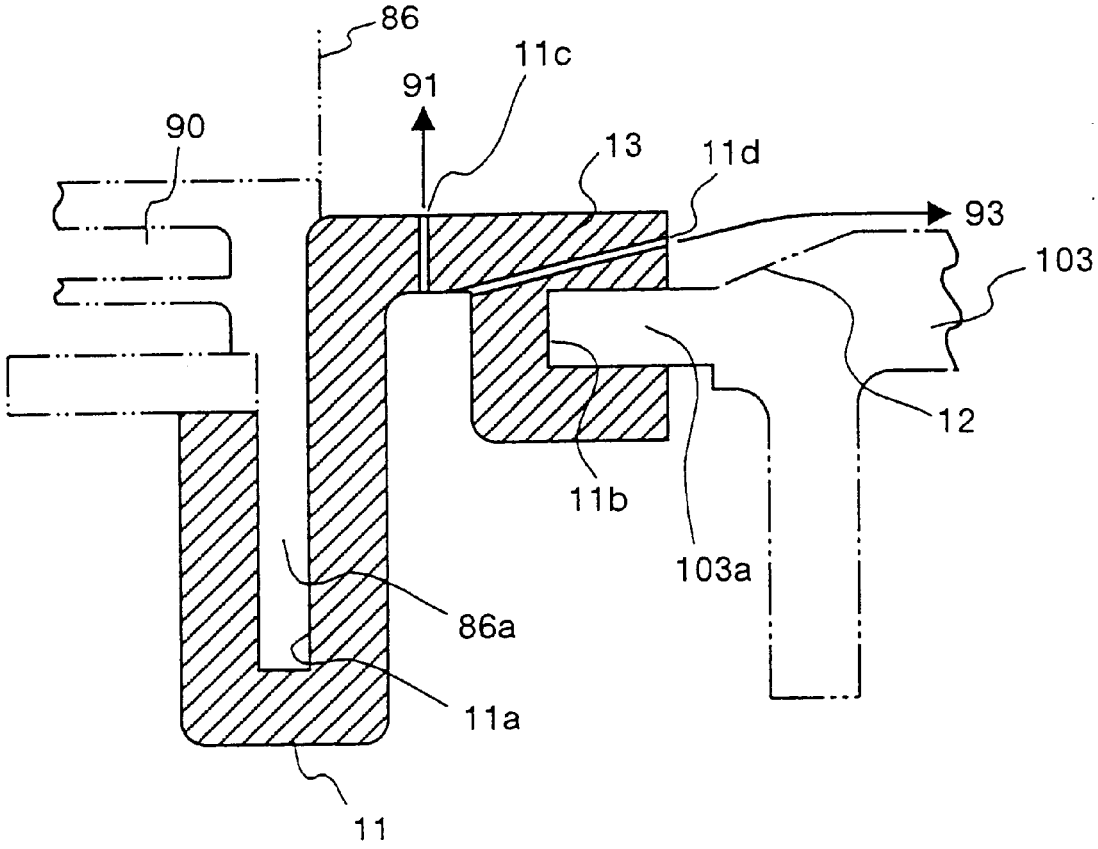
FIG. 2 is a partial sectional view of a tail tube seal structure of gas turbine combustor according to a second embodiment of the present invention.

FIG. 2 is a cross sectional view of a tail tube seal structure of gas turbine combustor according to the second embodiment of the present invention. The figure shows only the inside part. The structure of the tail tube outlet 86 side is basically the same as shown in FIG. 1. Namely, the tail tube outlet 86 and the gas pass side are connected by a tail tube seal 11, and the periphery is sealed. The shape of the tail tube seal 11 is basically same as the tail tube seal 1 shown in FIG. 1, except that a cooling hole lid and a flange slope 12 at the gas pass side are different.

In the tail tube seal 11, a cooling hole 11*c* is formed at the same position as the cooling hole 1*c* shown in FIG. 1, and air 91 flows out from the wall of the gas passage at the inner side, and the periphery of this portion is cooled. Moreover, in this embodiment, the inclined cooling hole 11*d* is formed obliquely in a wall 13 of the gas passage side of the groove 11*b*. Further, the flange slope 12 is provided by reducing the flange end 103*a* fitted in the groove 11*b* into the gas flow direction smoothly from the outlet of the groove 11*b*.

According to the second embodiment, the connection inlet side of the tail tube seal 11 is cooled by the air 91 flowing out of the cooling hole 11*c* in the same manner as in the conventional art. In addition, the wall of the gas passage side of the groove lib is cooled by the cooling air 93 flowing out from the inclined cooling hole 11*d*. Therefore, as in the first embodiment shown in FIG. 1, it is effective to reduce the wear due to a difference in thermal expansion between the groove 11*b* and the flange end 103*a* fitted thereto.

Further, in the second embodiment, air 93 flowing out from the cooling hole 11*d* flows out to the gas pass side along the smooth flange slope 12 at the gas pass side and cools the flange end 103*a* and the flange slope contiguous thereto by the film effect, thereby eliminating the difference in thermal expansion between the groove 11*b* of the tail tube seal 11 and the gas pass side flange 103*a,* so that the cooling effect of the upper partition of the groove 11*b* may be further enhanced.

Figure 3:
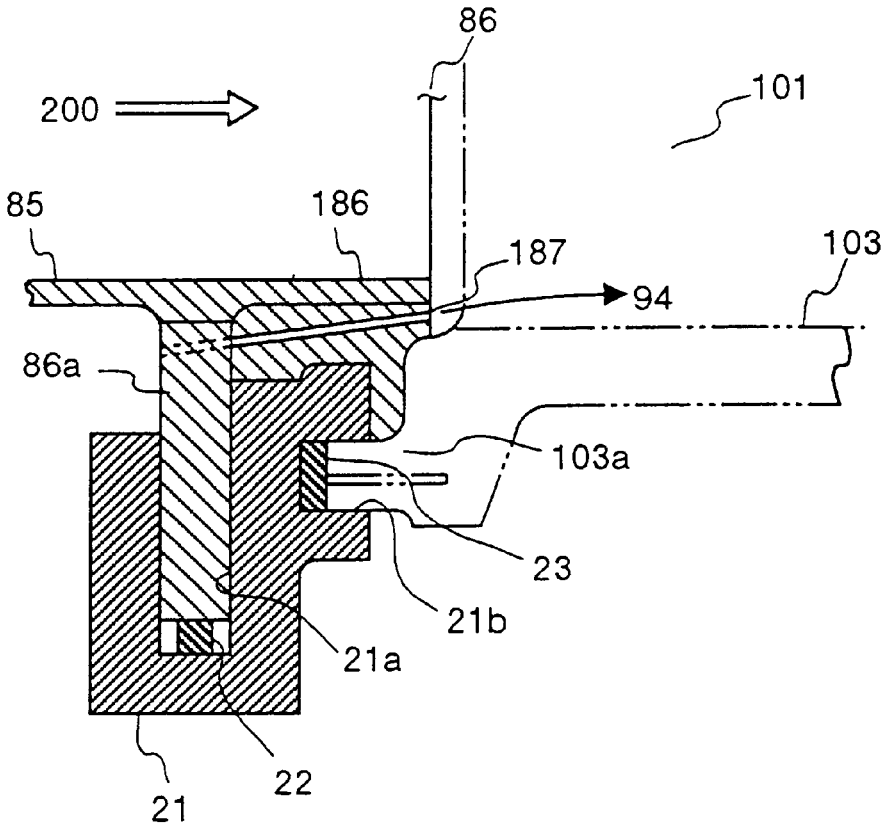
FIG. 3 is a partial sectional view of a tail tube seal structure of gas turbine combustor according to a third embodiment of the present invention.

FIG. 3 is a cross sectional view of a tail tube seal structure of gas turbine combustor according to the third embodiment of the present invention. The figure shows only the inside part. As shown in this figure, an outlet wall 186 projecting towards the outer side of the flange 86*a* is provided around the end portion of the tail tube outlet 86. Many cooling holes 187 are drilled in the outlet wall 186 along the periphery at an upward inclination toward the outlet. The tail tube seal 21 has a groove 21*a* fitted to the flange 86*a* at the tail tube outlet 86 side at one side, and a pi-shaped groove 21*b* at the other end. The structure of fitting to the gas pass side flange end 103*a* is basically same as the shape of the first and second embodiments shown in FIG. 1 and FIG. 2. A member is provided for fitting to an outer peripheral flange at the tail tube outlet 86 at one side, and fitting to a protrusion projecting toward upstream side at the outer side of the wall periphery of the tail tube outlet 86 from the junction of the gas pass inlet end periphery at other side.

In the third embodiment, a seal wire 22 is inserted between the groove 21*a* and the flange 86*a* leading end at the tail tube outlet 86 side. Further, a V-seal 23 is inserted between the groove 21*b* and the leading end of the flange end 103*a* at the gas pass side fitted thereto. This structure seals between the tail tube outlet 86 side and gas pass side.

According to the third embodiment, high temperature combustion gas 200 flows out to the gas pass side while contacting with an outlet wall 186 at the tail tube outlet 86, but it is not designed to contact with the tail tube seal 21. Therefore, it is not required to cool the tail tube seal 21 because it is assembled at the inner side not contacting directly with the gas passage, and hence cooling air is not needed. Instead, the tail tube side outlet wall 186 is cooled by the cooling air 94 flowing out from the cooling hole 187, but this cooling is a further addition to the cooling of the wall surface of the tail tube, and the amount of cooling air can be curtailed as compared to that required conventionally.

Figure 4:
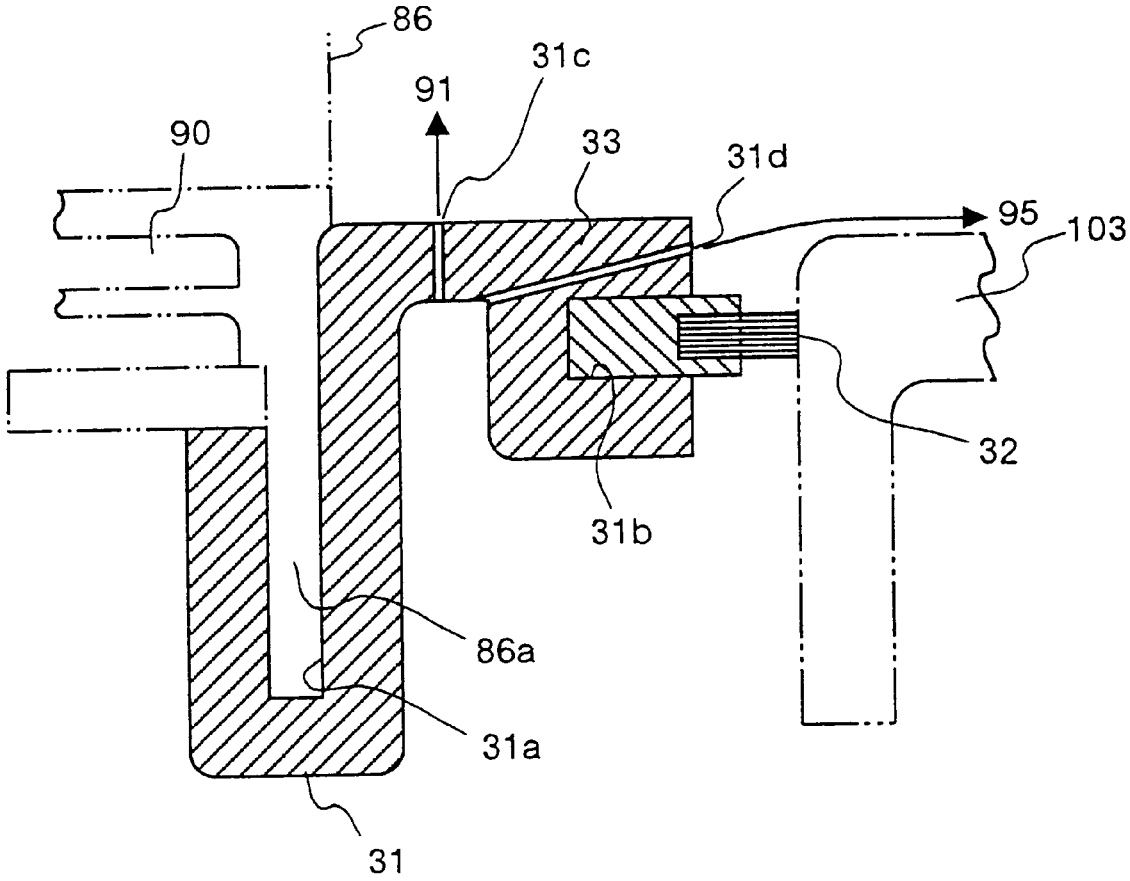
FIG. 4 is a partial sectional view of a tail tube seal structure of gas turbine combustor according to a fourth embodiment of the present invention.

FIG. 4 is a cross sectional view of a tail tube seal structure of gas turbine combustor according to the fourth embodiment of the present invention. The figure shows only the inside part. The structure of the tail tube outlet 86 is the same as that shown in FIG. 1 and FIG. 2. Namely, the shape of the tail tube seal 31 is basically the same as the tail tube seal 11 shown in FIG. 2, except that a brush seal 32 is provided.

As shown in FIG. 4, a U-shaped groove 31*a* is provided at one side of the tail tube seal 31. Further, a flange 86*a* of the tail tube outlet 86 is fitted in, and a pi-shaped groove 31*b* provided at other side. Further, a brush seal 32 is provided in the groove 31*b*. The brush of the brush seal 32 makes a contact with the side of the inner shroud 103 of the gas pass side thereby sealing this end.

In the fourth embodiment, the cooling hole 31*c* of the tail tube seal 31 is provided at the same position as the cooling hole 11*c* in the second embodiment shown in FIG. 2. Air 91 flows out to the wall of the inside gas passage to cool the surrounding area, and cooling air 95 flows obliquely into the cooling hole 31*d* to cool the wall 33 of the gas passage side of the groove 31*b,* and the air 95 flowing out from the cooling hole 31*d* flows out along the inner shroud 103, and cools the protrusion of the brush seal 32 and the end face of the inner shroud.

Therefore, the same effect as the second embodiment explained in FIG. 2 is obtained, and the brush seal 32 in the groove 31*b* can be cooled effectively. Further, by using the brush seal 32, if the tail tube seal 31 and the gas pass side inner shroud 103 move relatively, it is allowed to move relatively by sliding of the brush, and excessive force is not applied to the groove 31*b*.

Figure 5:
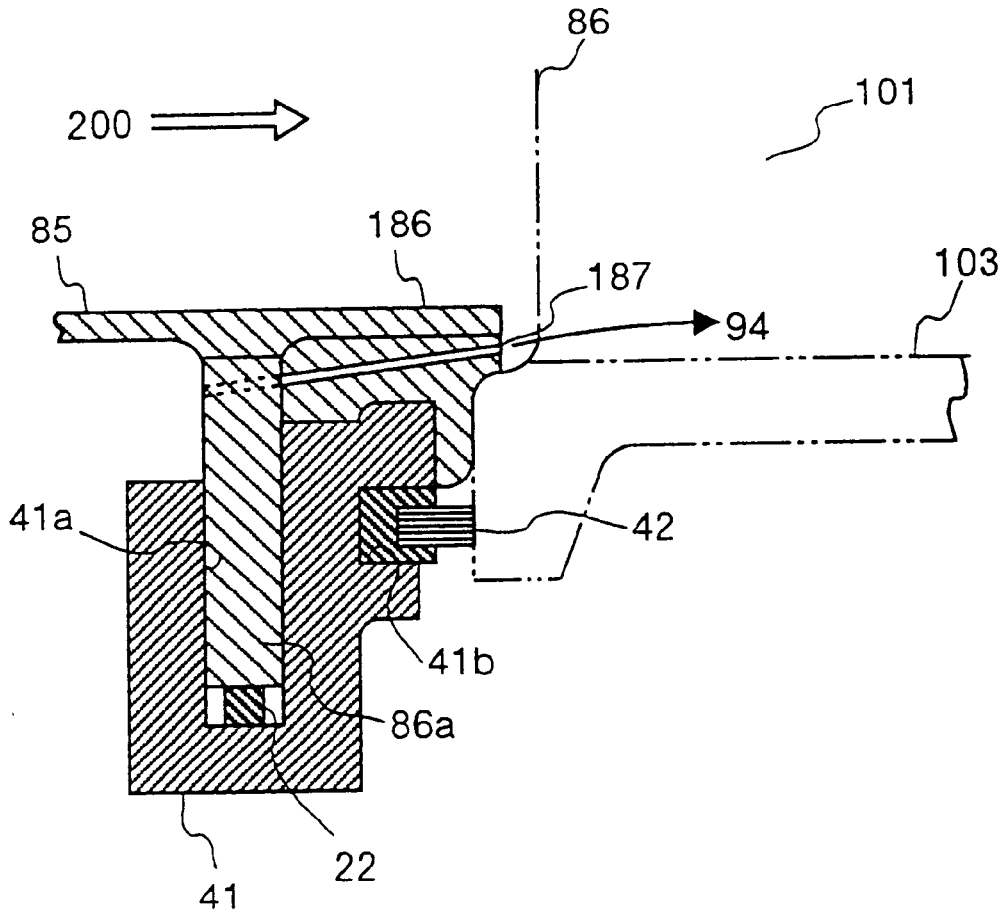
FIG. 5 is a partial sectional view of a tail tube seal structure of gas turbine combustor according to a fifth embodiment of the present invention.

FIG. 5 is a cross sectional view of a tail tube seal structure of gas turbine combustor according to the fifth embodiment of the present invention. The figure shows only the inside part. The structure of the tail tube outlet 86 is same as the structure of the third embodiment shown in FIG. 3. Namely, the shape of the tail tube 41 is basically same as that of the tail tube seal 21 shown in FIG. 3, however, the difference is that, a brush seal 42 is used.

As shown in FIG. 5, a U-shaped groove 41*a* is provided at one side of the tail tube seal 41. Further, a flange 86*a* of the tail tube outlet 86 is fitted, and a pi-shaped groove 41*b* is provided at other side. Further, a brush seal 42 is provided in the groove 41*b*. The brush of the brush seal 42 makes contact with the side of the inner shroud 103 of the gas pass side thereby sealing this end face. Further, a seal wire 22 is inserted between the groove 41*a* and the leading end of the flange 86*a* at the tail tube outlet 86 side, and the tail tube outlet 86 side is sealed.

In the fifth embodiment, same as in the third embodiment shown in FIG. 3, the high temperature combustion gas 200 flows out to the gas pass side in contact with an outlet wall 186 at the tail tube outlet 86, but it is not designed to contact with the tail tube seal 41. Therefore, it is not required to cool the tail tube seal 41 because it is assembled at the inner side not contacting directly with the gas passage, and hence cooling air is not needed. Instead, the tail tube side outlet wall 186 is cooled by the cooling air 94 flowing out from the cooling hole 187, but this cooling is a further addition to the cooling of the wall surface of the tail tube, and the amount of cooling air can be curtailed as compared to that required conventionally.

Further, by using the brush seal 42, if the tail tube seal 41 and the gas pass side inner shroud 103 should move relatively, it is allowed to move relatively by sliding of the brush, and excessive force is not applied to the groove 31*b*.

Figure 6:
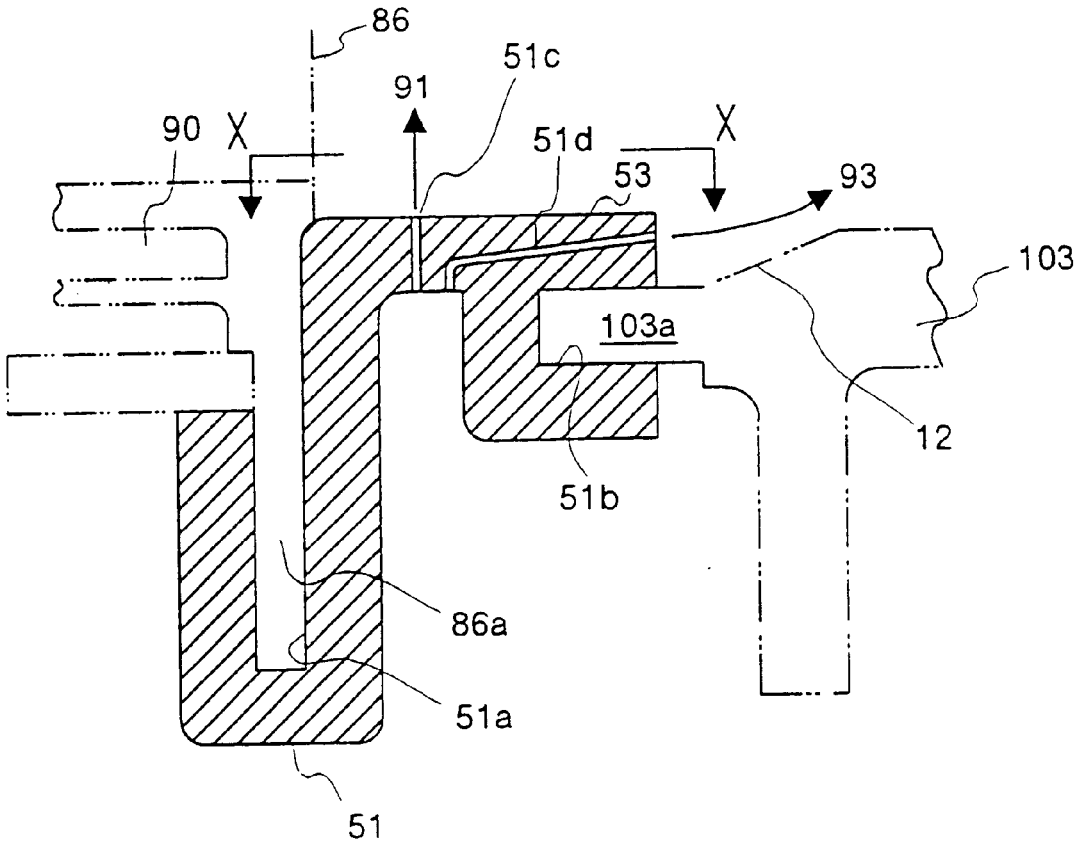
FIG. 6 is a partial sectional view of a tail tube seal structure of gas turbine combustor according to a sixth embodiment of the present invention.

FIG. 6 is a cross sectional view of a tail tube seal structure of gas turbine combustor according to the sixth embodiment of the present invention. The figure shows only the inside part. The structure of the tail tube outlet 86 and shape of the tail tube seal 51 are basically the same as in the second embodiment shown in FIG. 2. The feature of this embodiment lies in the shape and layout of the cooling holes 51*d* shown in FIG. 7.

As shown in FIG. 6, the tail tube seal 51 has a U-shaped groove 51*a* at one side in which a flange 86*a* is inserted, and a groove 51*b* is provided at other side, and the flange end 103*a* is fitted to compose the seal section. Air 91 flows out from a cooling hole 51*c* to the wall of the gas passage at the inner side, and the periphery of this portion is cooled. Moreover, an inclined cooling hole 51*d* is formed obliquely in a wall 53 of the gas passage side of the groove 51*b*. Further, the flange slope 12 is provided for reducing the flange end 103*a* fitted in the groove 51*b* into the gas flow direction smoothly from the outlet of the groove 51*b*. The structure explained here is basically the same as that shown in FIG. 2.

According to the sixth embodiment, the connection inlet side of the tail tube seal 51 is cooled by the air 91 flowing out of the cooling hole 51*c* in the same manner as in the conventional art. Further, the wall of the gas passage side of the groove 51*b* is cooled by the cooling air 93 flowing out from the inclined cooling hole 51*d*. Therefore, in the same manner as in the second embodiment shown in FIG. 2, it is effective to reduce the wear due to difference in thermal expansion between the groove 51*b* and the flange end 103*a* fitted thereto.

Further, in the sixth embodiment, air 93 flowing out from the cooling hole 51*d* flows out to the gas pass side along the smooth flange slope 12 at the gas pass side, and cools the flange end 103*a* and the flange slope 12 contiguous thereto by the film effect, thereby eliminating the difference in thermal expansion between the groove 51*b* of the tail tube seal 51 and the gas pass side, so that the cooling effect of the upper partition of the groove 51*b* may be enhanced same as in the second embodiment shown in FIG. 2.

Figure 7A:
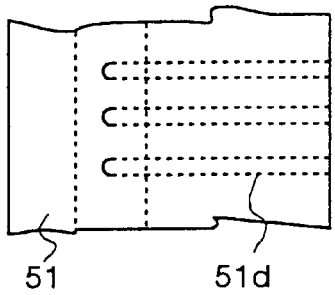
Figure 7D:
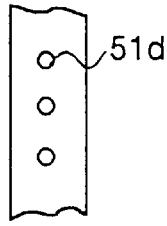
Figure 7B:
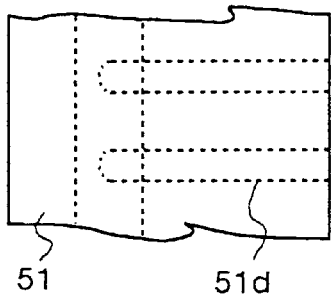
Figure 7E:
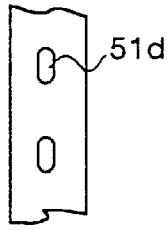
Figure 7C:
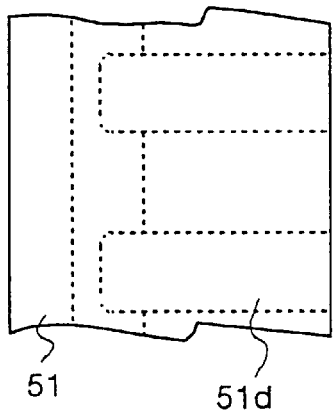
Figure 7F:
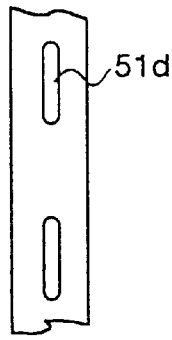

FIG. 7A to FIG. 7F show views when seen along the arrows 7—7 shown in FIG. 6 (cooling hole 51*c* being omitted). FIG. 7A to FIG. 7C show alternative embodiments of the application examples, and FIG. 7D to FIG. 7F show side views, respectively, of the embodiments of FIGS. 7A–7C. The cooling holes 51*d* may be circular in shape as shown in FIG. 7A and FIG. 7D, or may be elliptical in shape as shown in FIG. 7B and FIG. 7E, or may be slender in shape as shown in FIG. 7C and FIG. 7F. As preferable dimensions, when the holes are circular or elliptical their diameter may be of the order of 2 mm or equivalent to 2 mm, and when the holes are slender their length may be of the order of 4 to 8 mm, their width may be of the order of 0.8 to 1.5 mm. Further, it is desirable that the holes are drilled at a pitch of about 21 mm.

Figure 8:
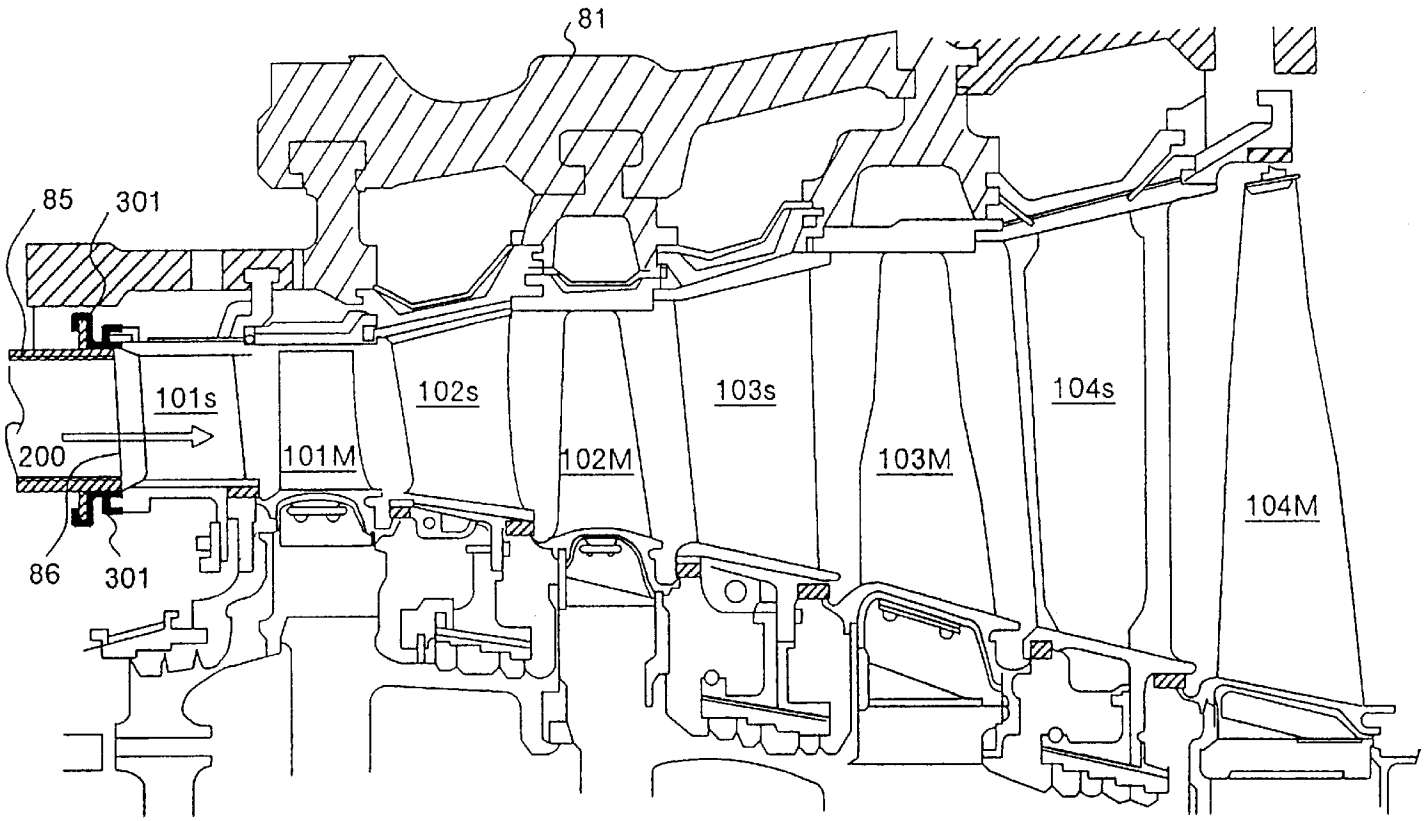
FIG.8 CONVENTIONAL ART
FIG. 8 is a general structural diagram of gas turbine applying the tail tube seal structure in any one of the first to sixth embodiments of the present invention.
Figure 9:
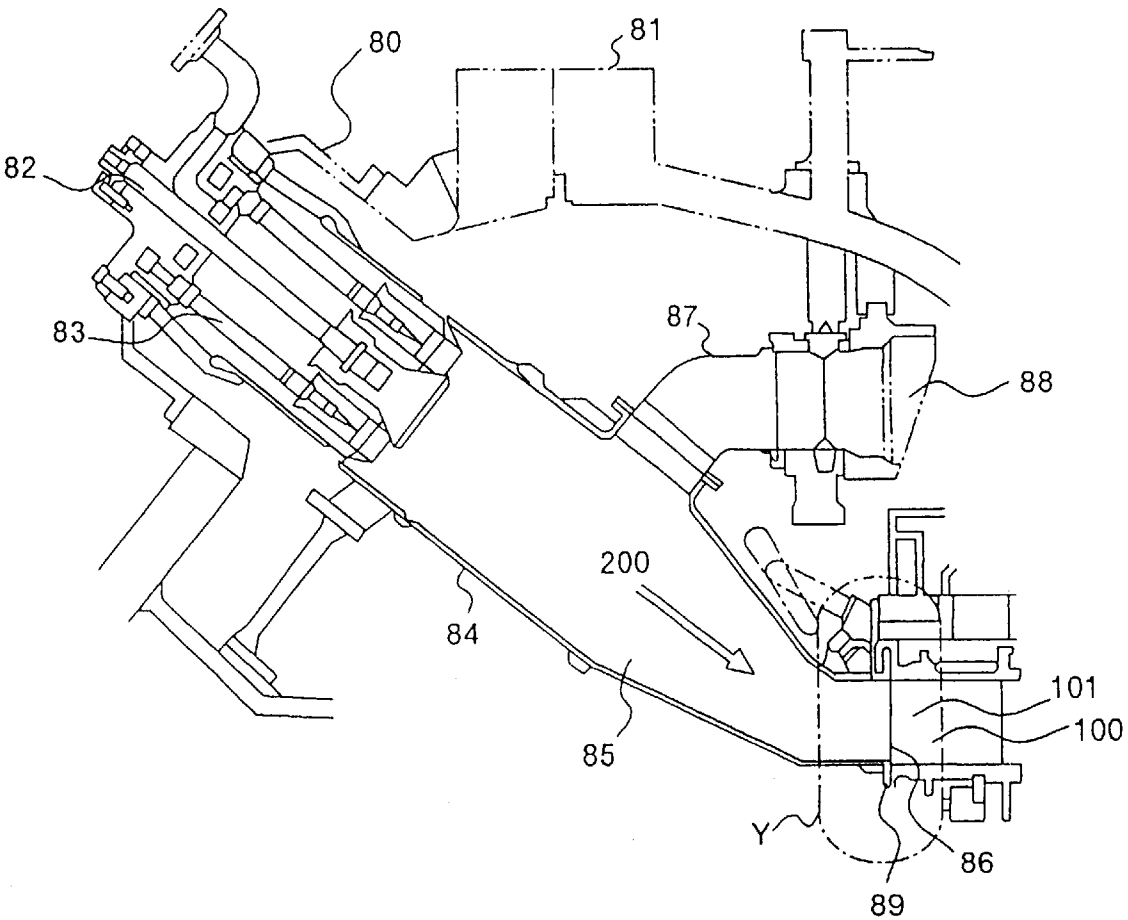
FIG.9 CONVENTIONAL ART
FIG. 9 is a general structural diagram of gas turbine combustor.

FIG. 8 is a general structural diagram of a gas turbine applying any one of the tail tube seals described in the first to sixth embodiments as the tail tube seal of gas turbine combustor. As shown in this figure, the tail tube outlet 86 of the tail tube 85 in the casing 81 and the gas pass are connected through a tail tube seal 301, and sealed. The tail tube seal 301 is any one of the tail tube seals described in the first to sixth embodiments, and is represented by reference numeral 301.

The gas pass of the gas turbine is composed of four stages of stationary blades 101*s*, 102*s*, 103*s*, 104*s*, and four stages of moving blades 101M, 102M, 103M, 104M. The high temperature combustion gas 200 passes through the tail tube outlet 86 through the tail tube 85 of the combustor, and is guided into the gas pass, and expanded to work and rotate the rotor. The tail tube seal 301 is selected in a proper shape for the structure of the combustor outlet unit and the inlet structure of the gas pass. As a result, the cooling effect of the tail tube seal is increased, the cooling air volume of the tail tube seal is curtailed, and it contributes to the enhancement of the performance of the entire gas turbine.

As explained above, according to the tail tube seal structure of combustor according to one aspect of the present invention, since the air in the casing flows in from the plurality of inclined cooling holes and flows out obliquely into the gas pass, and cools the wall contacting with the gas passage in the groove in which the flange end of the gas pass is fitted by film effect, the cooling in this area is reinforced. Owing to this cooling, the conventional problem of wear due to difference in thermal expansion between the fitting section of the member and the gas pass side flange end to be fitted is decreased, and the reliability of the tail tube seal structure is enhanced.

Further, since the inclined cooling holes are provided at specific intervals in the whole peripheral direction of the wall along the gas pass of the wall, it can be cooled uniformly and efficiently also in the peripheral direction. Same as above, wear of groove and its fitting flange can be decreased, and the reliability of the tail tube seal structure is enhanced.

Further, since a smooth slope is formed so that the air flowing out from the inclined cooling holes may flow smoothly along the inner wall of the gas pass side, the film cooling effect is enhanced, and cooling of the flange end portion of the gas pass side is further effective.

According to the tail tube seal structure of combustor according to another aspect of the present invention, since the member is fitted outside to the flange of the outer circumference of the tail tube outlet, and also fitted to the protrusion at the gas pass side on the outer periphery of the tail tube outlet wall, the member itself does not contact directly with the high temperature combustion gas. Therefore, it is not necessary to cool the member itself, and hence cooling holes and cooling are not needed.

Further, since the seal member is placed in the fitting section between the tail tube outlet flange and the protrusion member at the gas pass side, the tail tube outlet peripheral flange end and the gas pass side protrusion are sealed securely, and the effect of the present invention is further encouraged.

Further, since the brush seal is used, the brush seal seals by contacting with the smooth plane of the flange end of the gas pass side, and if a relative deviation occurs between the gas pass side flange end and the tail tube side, by sliding of the brush seal, it is possible to move relatively depending on the deviation, and excessive force is not applied to the connection area, so that the reliability of the tail tube seal is enhanced.

Further, since the brush seal is used, in addition to the above effects, if a relative deviation occurs between the gas pass inlet side and the tail tube side, it is possible to move relatively, corresponding to this deviation, by sliding of the brush seal without spoiling the sealing performance, and excessive force is not applied to the connection area, so that the effects of the present invention may be assured.

Further, the shape of the inclined cooling holes is either circular or elliptical, and the hole shape can be selected depending on the type or structure of combustor, or by forming slender holes, the number of holes may be decreased, and the shape of the inclined cooling holes may be selected appropriately depending on the size or shape of the combustor, size at the gas pass side and other conditions, and the freedom of design is wider, which contributes to optimum designing.

The present invention further provides a gas turbine applying a tail tube seal structure of combustor of any one of those describe above in the connection area of the tail tube outlet of the combustor and gas pass inlet, and therefore, from the variety of tail tube seal structures exemplified herein, the best tail tube seal structure can be selected depending on the capacity or type of the gas turbine, and by using it, a gas turbine enhanced in the cooling effect in the tail tube seal, curtailed in the amount of cooling air, and enhanced in performance is realized.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A tail tube sealing structure for a combustor having a tail tube outlet including a first flange, and a shroud with a second flange, said combustor receiving compressed air from a compressor that discharges a first amount of the compressed air, said tail tube sealing structure defining a gas passage and comprising a member having a wall defined by an inside surface and an outside surface, said member having a first groove fitting the first flange around said tail tube outlet and having a second groove having a bottom and fitting the second flange of said shroud, said member having a plurality of first cooling holes disposed at a first position in a gas flow direction and extending through the wall between the outside surface and the inside surface so as to pass cooling air into said gas passage, and a plurality of second cooling holes disposed at a second position downstream of said first position and adjacent to the first cooling holes, said second cooling holes extending through the wall between the outside surface and the inside surface in the gas flow direction and being open to said gas passage on the inside surface at a third position in the gas flow direction, the third position being located on, or downstream in the gas flow direction of, an imaginary annular curved line defined as an intersection of an imaginary plane substantially flush with the bottom of said second groove with said inside surface, said first cooling holes and said second cooling holes passing the cooling air in a second amount, whereby the film cooling effect on the inside surface is enhanced to thereby decrease frictional force generated upon contract of said member with said second flange of said shroud, and whereby the second amount of the cooling air is reduced to at most about 1 to 2% of the first amount of the compressed air discharged from said compressor.

2. The tail tube seal structure of a combustor according to claim 1, wherein said second cooling holes are provided at intervals around the periphery of the wall along the gas pass of said member.

3. The tail tube seal structure of a combustor according to claim 1, wherein a smooth slope is formed in the inner surface of the wall contiguous to the second flange so that the air flowing out from said second cooling holes may flow in the gas flow direction.

4. The tail tube seal structure of a combustor according to claim 1, wherein said second flange defines a smooth surface, a brush seal is provided in the second groove of said member, and said brush seal contacts with the smooth surface of said flange end.

5. The tail tube seal structure of a combustor according to claim 1, wherein said second cooling holes are at least one of circular or elliptical.

6. The tail tube seal structure of a combustor according to claim 1, wherein said second cooling holes are slender holes.

7. A gas turbine having a combustor with a tail tube outlet, including a first flange on the periphery of said outlet, a shroud with a second flange, said combustor receiving compressed air from a compressor that discharges a first amount of the compressed air, and a tail tube seal structure for a sealed connection between the tail tube outlet and the shroud, the tail tube outlet, the seal structure and the shroud defining a gas passage for flow of gas from an upstream position at the tail tube outlet toward a downstream position at the shroud in a gas flow direction, said tail tube seal structure comprising a member having a wall defined by an inside surface and an outside surface, said member having a first groove fitting the first flange around said tail tube outlet and having a second groove having a bottom and fitting the second flange of said shroud, said member having a plurality of first cooling holes disposed at a first position in the gas flow direction and extending through the wall between the outside surface and the inside surface so as to pass cooling air into said gas passage, and a plurality of second cooling holes disposed at a second position downstream of said first position and adjacent to the first cooling holes, said second cooling holes extending through the wall between the outside surface and the inside surface in the gas flow direction and being open to said gas passage on the inside surface at a third position in the gas flow direction, the third position being located on, or downstream in the gas flow direction of, an imaginary annular curved line defined as an intersection of an imaginary plane substantially flush with the bottom of said second groove with said inside surface, said first cooling holes and said second cooling holes passing the cooling air in a second amount, whereby the film cooling effect on the inside surface is enhanced to thereby decrease frictional force generated upon contact of said member with said second flange of said shroud, and whereby the second amount of the cooling air is reduced to at most about 1 to 2% of the first amount of the compressed air discharged from said compressor.

8. The tail tube seal structure of a combustor according to claim 7, wherein said second cooling holes are provided at intervals around the periphery of the wall along the gas pass of said member.

9. The tail tube seal structure of a combustor according to claim 7, wherein a smooth slope is formed in the inner surface of the wall contiguous to the second flange so that the air flowing out from said second cooling holes may flow in the gas flow direction.

10. The tail tube seal structure of a combustor according to claim 7, wherein said second flange defines a smooth surface, a brush seal is provided in the second groove of said member, and said brush seal contacts with the smooth surface of said flange end.

11. The tail tube seal structure of a combustor according to claim 7, wherein said second cooling holes are at least one of circular or elliptical.

12. The tail tube seal structure of a combustor according to claim 7, wherein said second cooling holes are slender holes.

* * * * *